US008418812B1

(12) United States Patent
Rosen et al.

(10) Patent No.: US 8,418,812 B1
(45) Date of Patent: Apr. 16, 2013

(54) RIBBED DRAIN PLUG

(75) Inventors: Ian K. Rosen, North Muskegon, MI (US); John M. Peirce, Portage, MI (US)

(73) Assignee: AGS I-Prop, LLC, Muskegon, MI (US)

( * ) Notice: Subject to any disclaimer, the term of this patent is extended or adjusted under 35 U.S.C. 154(b) by 192 days.

(21) Appl. No.: 12/856,731

(22) Filed: Aug. 16, 2010

Related U.S. Application Data

(60) Provisional application No. 61/235,840, filed on Aug. 21, 2009.

(51) Int. Cl.
*F01M 11/04* (2006.01)

(52) U.S. Cl.
USPC ..... 184/1.5; 220/288; 411/371.1

(58) Field of Classification Search ..... 184/1.5; 220/288; 411/371.1
See application file for complete search history.

(56) References Cited

U.S. PATENT DOCUMENTS

| | | | | |
|---|---|---|---|---|
| 1,606,519 | A | 11/1926 | Exten | |
| 3,387,621 | A | 6/1968 | Schaff | |
| 3,933,358 | A * | 1/1976 | Hoer | 277/637 |
| 4,146,207 | A * | 3/1979 | Rofe | 251/120 |
| 4,531,767 | A * | 7/1985 | Andreolla | 285/220 |
| 4,875,818 | A * | 10/1989 | Reinwall | 411/369 |
| 5,107,808 | A * | 4/1992 | Mahn et al. | 123/195 C |
| 5,183,267 | A | 2/1993 | Ackerman et al. | |
| 5,188,495 | A * | 2/1993 | Jones, Jr. | 411/369 |
| D363,767 | S * | 10/1995 | Swaim | D23/260 |
| 5,971,189 | A * | 10/1999 | Baughman | 220/288 |
| 6,173,969 | B1 * | 1/2001 | Stoll et al. | 277/630 |
| 6,231,286 | B1 * | 5/2001 | Bogatz et al. | 411/371.1 |
| 6,485,242 | B1 * | 11/2002 | Kikawa et al. | 411/369 |
| 6,863,156 | B2 * | 3/2005 | Seemann | 184/1.5 |
| 7,150,828 | B2 | 12/2006 | Sakata et al. | |
| 7,306,418 | B2 * | 12/2007 | Kornblum | 411/352 |
| 7,357,225 | B2 * | 4/2008 | Dorian | 184/1.5 |
| 7,427,181 | B2 | 9/2008 | Denton et al. | |
| 7,645,105 | B2 * | 1/2010 | Hengel et al. | 411/171 |
| 7,905,367 | B2 * | 3/2011 | Jessberger | 215/356 |
| 2008/0135335 | A1 | 6/2008 | Lowman | |

FOREIGN PATENT DOCUMENTS

| | | |
|---|---|---|
| JP | 2006-138437 | 6/2006 |

* cited by examiner

*Primary Examiner* — William E Dondero
*Assistant Examiner* — Michael Riegelman
(74) *Attorney, Agent, or Firm* — Gardner, Linn, Burkhart & Flory, LLP

(57) ABSTRACT

A drain hole sealing system has a ribbed drain plug that includes a shaft for engaging the drain hole of a fluid container, a head portion for engaging a tool, and at least one annular rib or ridge or projection extending from the head portion in the same direction as the threaded shaft and concentric therewith. The annular rib or ribs provide compressive and biting engagement with an annular deformable seal positioned concentrically around the drain hole that is engaged by the shaft of the drain plug. At least one annular rib moves into biting engagement with the annular deformable seal so that the seal deforms at least partially around the annular rib when the drain plug is tightened.

22 Claims, 6 Drawing Sheets

RIBBED DRAIN PLUG

CROSS REFERENCE TO RELATED APPLICATION

The present application claims the priority benefit of U.S. provisional application Ser. No. 61/235,840, filed Aug. 21, 2009, which is hereby incorporated herein by reference in its entirety.

FIELD OF THE INVENTION

The present invention relates generally to drain plugs and, more particularly, to drain plugs for use on fluid containers, such as oil pans and the like.

BACKGROUND OF THE INVENTION

Drain plugs are commonly used for sealing fluid drain holes, such as those commonly used on engine oil pans and the like, and may be susceptible to leakage due to fluid pressure at the drain hole, which is typically located at or near the lowest point in the oil pan.

SUMMARY OF THE INVENTION

The present invention provides a ribbed drain plug and a drain hole sealing system or assembly for sealing fluid drain holes, such as a drain hole of an engine oil pan or the like. The ribbed drain plug includes a threaded shaft for engaging a threaded drain hole, a head portion including a tool-engaging region to facilitate rotation or installation and removal of the plug, and a flange or planar surface that generally faces or opposes the oil pan when the drain plug is installed thereat. At least one annular rib or ridge or projection is disposed along the planar surface of the head portion and disposed concentrically around the threaded shaft. The annular rib or ridge or projection extends a short distance from the planar surface and in the same direction as the threaded shaft. An annular deformable seal is disposed or established around the threaded shaft of the drain plug and around the drain hole, and is engaged and at least partially compressed by the annular rib as the threaded shaft is tightened into the drain hole.

The annular rib may be narrower in width than the deformable seal so that the rib engages and bites into the seal along only a portion of the width of the seal. Thus, the ribbed drain plug and drain hole sealing system of the present invention provides an enhanced seal for a drain hole by driving a rib in the axial direction of the threaded shaft of the drain plug to bite into a deformable seal (such as into a generally central or middle portion of the seal) that is disposed around the threaded drain plug hole.

These and other objects, advantages, purposes, and features of the present invention will become apparent upon review of the following specification in conjunction with the drawings.

DESCRIPTION OF THE PREFERRED EMBODIMENTS

Figure 1:
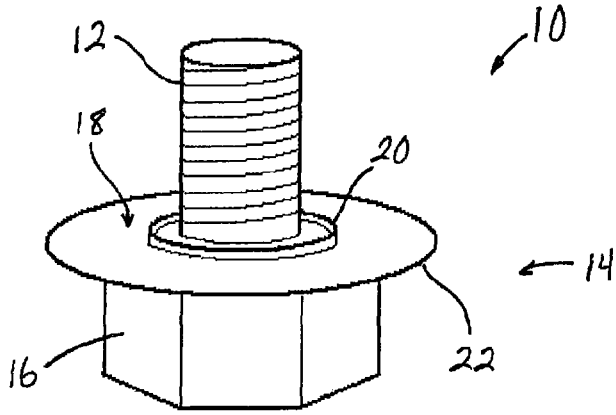
FIG. 1 is a perspective view of a ribbed drain plug in accordance with the present invention.

Referring now to the drawings and the illustrative embodiments depicted therein, a ribbed drain plug 10 includes a threaded shaft 12 and a head portion 14 at a proximal end of the threaded shaft (FIG. 1). Head portion 14 includes a tool-engaging region 16 (such as a hexagonal-shaped portion or region that is received in or by a wrench or socket or tool for rotatably tightening or loosening the drain plug) and a generally planar surface 18 facing the direction from which threaded shaft 12 extends or projects from head portion 14. An annular rib or ridge or projection 20 is disposed along planar surface 18 and concentrically around threaded shaft 12, and extends or projects outwardly from planar surface 18 in the same direction as threaded shaft 12. Optionally, a flange 22 is formed or established at head portion 14 and forms the planar surface 18 from which annular rib 20 and threaded shaft 12 extend.

Figure 2:
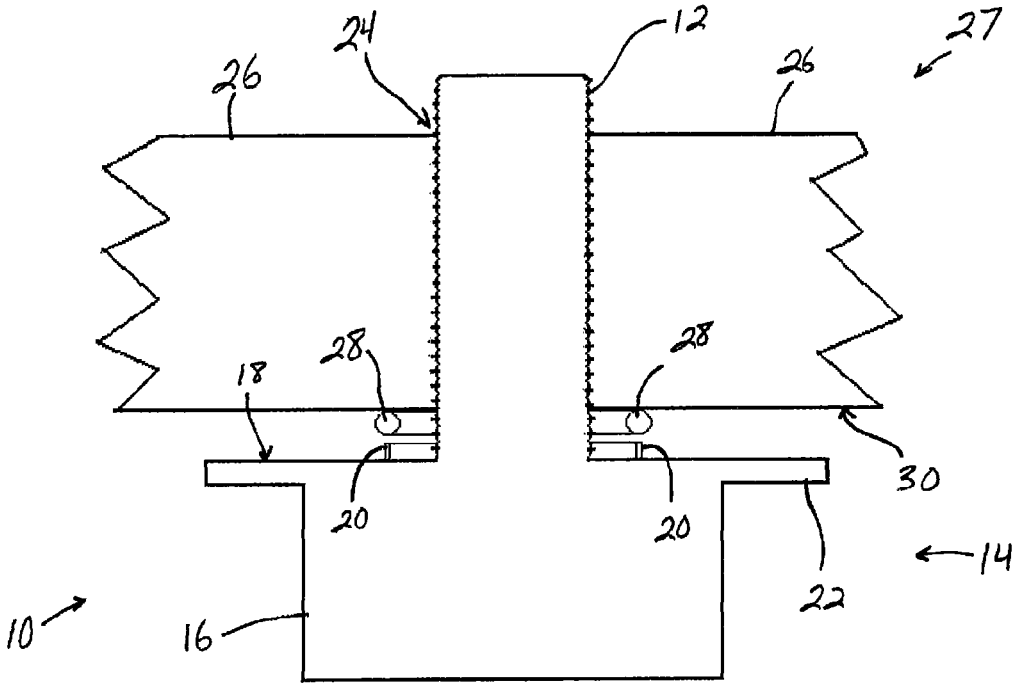
FIG. 2 is a side sectional elevation of the drain plug of FIG. 1, shown as partially threaded into a drain hole of an oil pan.

Threaded shaft 12 is configured to threadedly engage a correspondingly-threaded drain hole 24, such as may be established in the bottom wall 26 of an oil pan or other fluid container 27 (FIG. 2). For example, the drain plug shaft 12 may be threaded into the threaded drain hole and secured or tightened therein to limit or preclude draining of the oil or fluid in the pan or container. In the illustrated embodiment, threaded shaft 12 includes male threads for engaging corresponding female threads established in drain hole 24, as is known in the art. The shaft and drain plug may be rotated via an appropriate tool engaging the tool-engaging region 16 of the head portion 14 of the drain plug 10. Optionally, the shaft may be formed with a twist-lock feature wherein the drain plug may be inserted into the drain hole, pushed tightly against the wall in which the hole is established, and rotated (typically less than a full turn) to lock the corresponding twist-lock features established on the shaft and in the drain hole.

In the illustrated embodiment, tool-engaging region 16 comprises a hex-shaped head for engagement by a conventional wrench or socket or the like to facilitate rotation of the drain plug. It will be appreciated that other tool-engaging shapes or features may be used without departing from the spirit and scope of the present invention. For example, square-headed or other polygonal shapes, socket cavities of various shapes including hex-shaped, Phillips or flat screwdriver shapes, tamper-resistant shapes, hand-tightenable shapes (such as, for example, a "wing nut") or the like may be established at or in the head portion of the drain plug to facilitate rotation of the drain plug.

Figure 4:
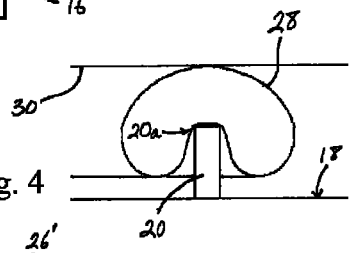
FIG. 4 is an enlarged view of the area designated 'IV' in FIG. 3.
Figure 7:
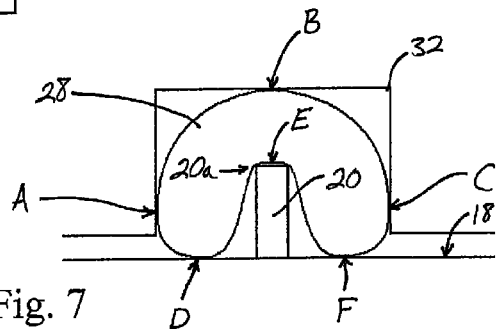
FIG. 7 is an enlarged view of the area designated 'VII' in FIG. 6.

In the illustrated embodiment, rib 20 is generally hoop-shaped with a rectangular cross-section as best seen in FIGS. 1, 4, and 7. The rib may be unitarily formed with the drain plug including the head portion and the threaded shaft. As described above, rib 20 projects away from planar surface 18 and is substantially concentric with threaded shaft 12. It will be appreciated that various other cross-sectional shapes of annular ribs may be used without departing from the spirit and scope of the present invention. For example, ribs having a triangular shape or profile (such as an inverted 'V'), a square shape or profile, a round or curved shape or profile (e.g. similar to a half-circle or portion of a sine-wave), or the like may be used. At least a distal end portion 20*a* of rib 20 (FIGS. 4 and 7) has a cross-sectional shape that is narrower in width than that of a corresponding annular resilient seal 28 so that the distal end portion 20*a* of the rib can bite into the seal rather than compressing the seal evenly. Thus, although the overall diameters of the rib and the resilient seal may be substantially the same, the width of the portion of the rib that initially contacts and bites into the seal is narrower than the width of the seal so that the compressive force of the rib is applied to only a generally central portion of the seal or portion of the seal that is between the inner and outer portions or edge regions of the seal.

Figure 3:
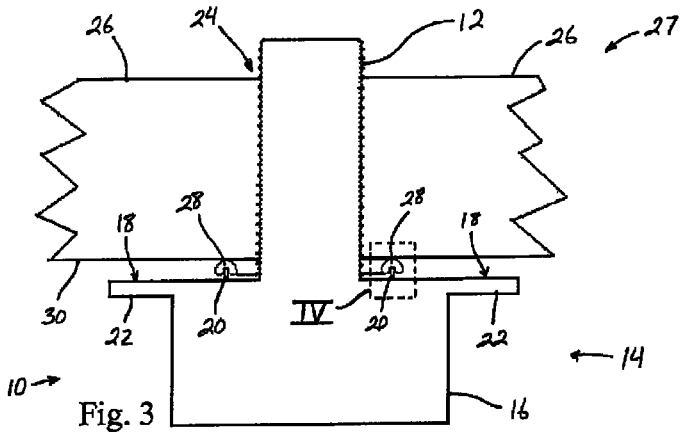
FIG. 3 is another side sectional view of the drain plug and oil pan of FIG. 2, shown with the drain plug fully threaded into the drain hole of the oil pan.

The annular deformable seal 28 is positioned along a lower surface 30 of bottom wall 26 and is concentric with a lower opening of drain hole 24. Deformable seal 28, which may be in the form of a rubber O-ring or the like, has a central diameter (i.e. defined centrally between the seal's inner diameter and its outer diameter) that generally corresponds to the central diameter of the annular rib 20, such as shown in FIGS. 2 and 3. Optionally, the seal may be configured and disposed at the drain hole such that the annular rib bites into or engages any portion of the seal between its outer diameter edge region and inner diameter edge region.

Ribbed drain plug 10 may be made from any sufficiently strong, machinable material, such as various grades of metals including steel, or may be made of polymeric or resinous materials or the like such as for lighter-duty applications. Threaded shaft 12, head portion 14, flange 22, and annular rib 20 may be unitarily formed from a single piece of material. Annular resilient seal 28 is made of a softer material than drain plug 10, and particularly annular rib 20, so that rib 20 can bite into and deform seal 28 in a manner that will be described below. For example, annular resilient seal 28 may be made of any suitable resilient material such as a rubber or silicon or synthetic non-metal material or the like, or may be made of relatively soft metal that is readily deformed, such as copper or the like.

Thus, a drain hole sealing system is provided in which the ribbed drain plug 10 may be threaded into the drain hole 24 of a fluid container (FIG. 2) and tightened until the annular rib or ridge 20 compressively engages the annular resilient seal 28 to form a fluid-tight coupling between the rib and the resilient seal, such as shown in FIG. 3. As the plug is rotated and tightened, the annular rib 20 rotates about its axis (which it shares with that of the threaded shaft, due to their concentricity) and translates in an axial direction along this axis until it contacts and is tightened against the resilient seal 28. It will be observed that, due to its width and alignment with seal 28, the annular rib 20 acts or impinges upon only a generally central portion of the deformable seal 28 so that the annular rib 20 "bites" into the seal, which then deforms and at least partially surrounds a portion of the annular rib (FIG. 3). Thus, a fluid-tight seal is formed between the annular seal 28 and the lower surface 30 of bottom wall 26, and also between deformable seal 28 and annular rib 20, which substantially prevents fluid from exiting the fluid container through drain hole 24. Optionally, the annular seal may have an inside diameter that generally corresponds with the outside diameter of the shaft portion of the drain plug, such that the seal may be generally retained at the appropriate position relative to the annular rib during the tightening process, in order to ensure that the rib engages and bites into the seal substantially entirely along the seal.

Figure 5:
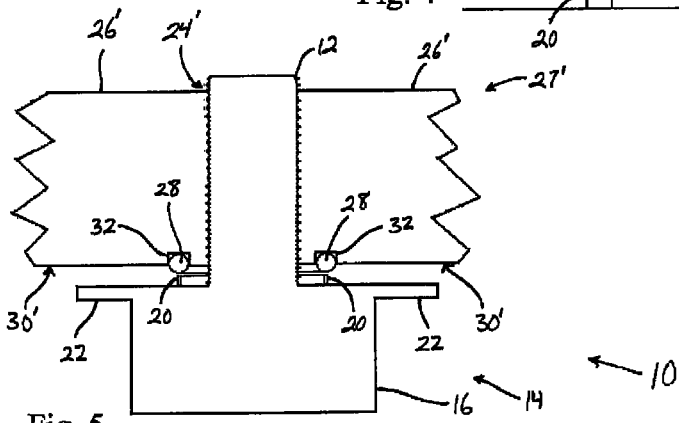
FIG. 5 is a side sectional view of the drain plug of FIG. 1, shown partially threaded into an oil pan having an annular groove for receiving an O-ring.
Figure 6:
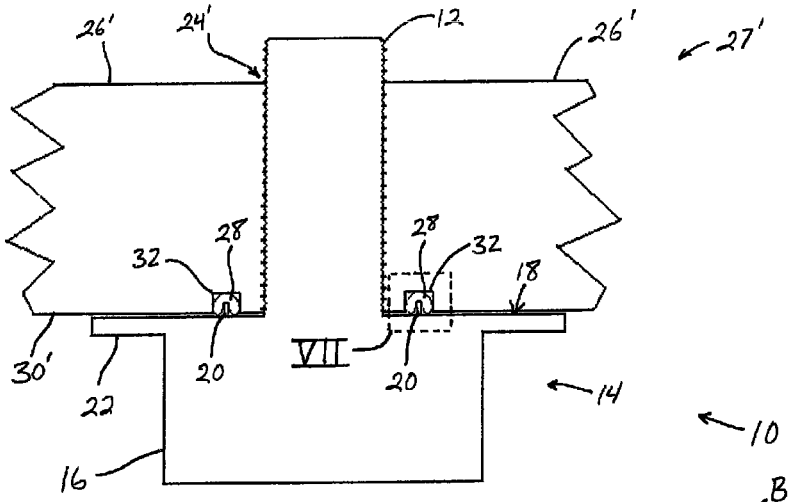
FIG. 6 is another side sectional view of the drain plug and oil pan of FIG. 5, shown with the drain plug fully threaded into the drain hole of the oil pan.

As shown in FIGS. 2 and 3, the seal may be disposed against a generally planar surface 30 of the oil pan 27. Optionally, and with reference to FIGS. 5 and 6, the lower surface 30' of the bottom wall 26' of an oil pan or container 27' includes an annular groove 32 for receiving the annular deformable seal 28 and holding it in alignment with the rib 20 of drain plug 10 as the ribbed drain plug 10 is threaded into drain hole 24' Annular groove 32 supports and stabilizes deformable seal 28 as the annular rib 20 compresses and bites into the seal and, further, establishes multiple contact points or sealing interfaces, such as those labeled A-F in FIG. 7, for maintaining a fluid-tight seal at the bottom of oil pan or container 27'.

Figure 8:
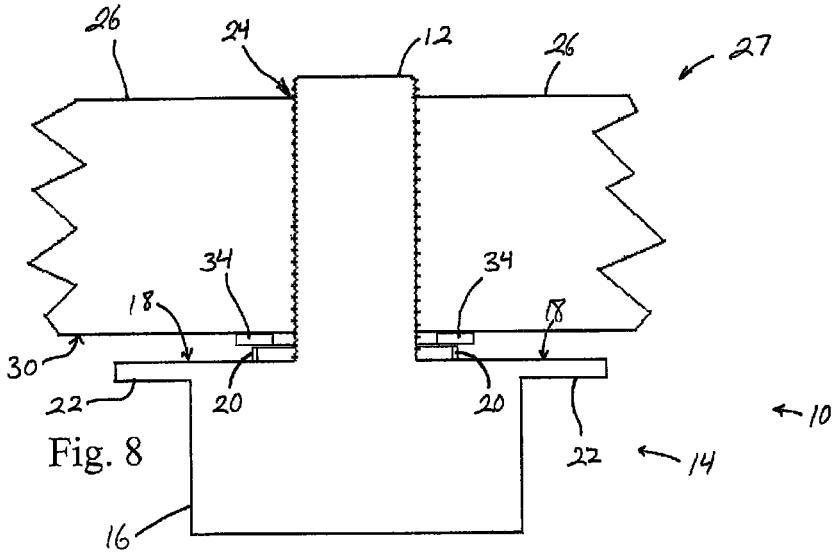
FIG. 8 is a side sectional view of the drain plug of FIG. 1, shown partially threaded into the drain hole of an oil pan equipped with a flat, annular deformable seal.
Figure 9:
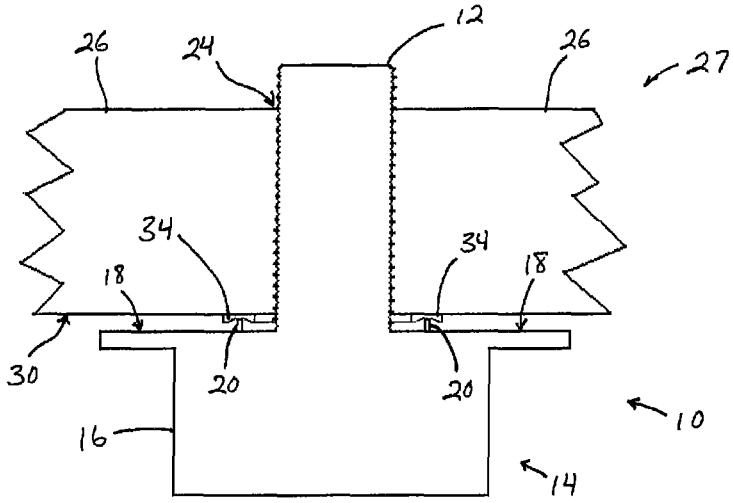
FIG. 9 is a side sectional view of the drain plug and oil pan of FIG. 8, with the drain plug fully threaded into the drain hole of the oil pan.

Optionally, a flat or flat-section annular deformable seal 34, such as shown in FIGS. 8 and 9, may be used in place of a conventional round-section O-ring, to facilitate alignment and engagement of the annular rib 20 with the surface of the seal. The flat annular seal 34 may be more suitable for applications where an annular groove (such as groove 32 of FIGS. 5-7) is not provided, and the seal is compressed against the generally planar lower surface 30 of the bottom wall 26 of oil pan 27 (FIG. 9). Thus, the flat annular seal 34 will tend to remain in place as the drain plug is tightened to press or bite the annular rib 20 into flat seal 34, whereas an unsupported round-section O-ring (such as shown in FIGS. 2 and 3) may tend to move or roll away from the annular rib as the rib is compressed into the O-ring. Optionally, the inner diameter of seal 34 may generally correspond with the outer diameter of the shaft to maintain alignment of the seal as the rib engages the seal during tightening of the drain plug.

Figure 10:
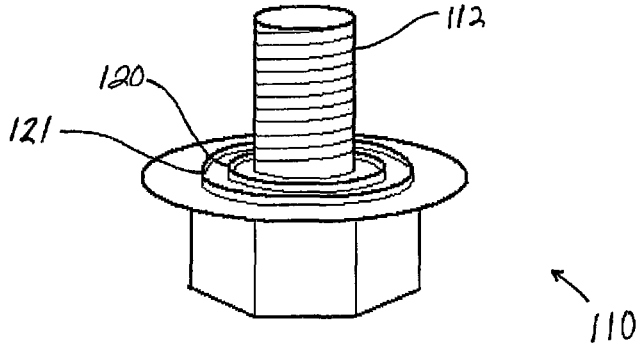
FIG. 10 is a perspective view of another ribbed drain plug having two spaced annular ribs in accordance with the present invention.

Although shown and described as having a single annular rib at the flange or engaging or planar surface of the drain plug, other configurations are contemplated within the spirit and scope of the present invention. Optionally, the drain plug may have two or more or multiple (such as three or more) ribs. For example, and with reference to FIG. 10, a drain plug 110 may include a first rib 120 and a second rib 121 (and may include a third rib, or fourth rig, etc.) established at the planar surface 118. Second rib 121 is spaced radially outward from the first rib 120, and is concentric with both the first rib and the threaded shaft 112. The second rib 121 may engage a corresponding second resilient seal or gasket surrounding the drain hole to which the drain plug is fitted, or may engage an outer region of a larger seal that is also engaged at its inner region by the first annular rib 120. It will be appreciated that substantially any number of annular ribs and corresponding seals or seal portions may be used without departing from the spirit and scope of the present invention.

Figure 11:
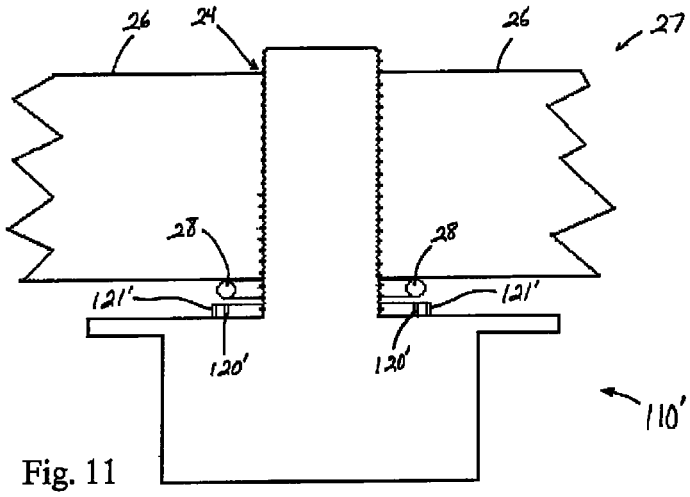
FIG. 11 is a side sectional view of another ribbed drain plug having two closely-spaced annular ribs, the drain plug shown as partially threaded into the drain hole of an oil pan.
Figure 12:
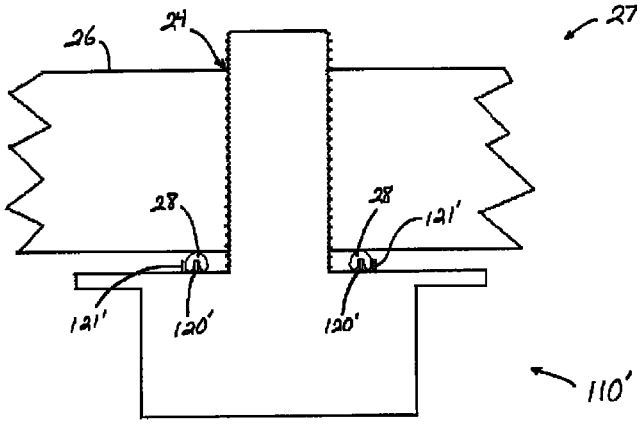
FIG. 12 is a side sectional view of the drain plug and oil pan of FIG. 11, shown with the drain plug fully threaded into the drain hole of the oil pan.

Optionally, and as shown in FIGS. 11 and 12, a ribbed drain plug 110' may include a first annular rib or projection 120' positioned inboard of a concentric second annular rib or projection 121'. The second annular rib 121' is spaced relatively closely to the first annular rib 120' to enhance the sealing properties of the first annular rib 120' against the deformable seal 28. Second annular rib 121' may serve to support the outer perimeter edge or surface of the annular deformable seal 28 when the ribbed drain plug 110' is fully tightened into the drain hole 24 of the oil pan or container 27. When deformable seal 28 is compressed by first annular rib 120', second annular rib 121' may be disposed at or against the outer perimeter edge region of seal 28 and may also form an additional sealing interface between annular seal 28 and drain plug 110'. Optionally, the seal may be configured so that the outboard rib 121' engages and bites into the seal while the inboard rib 120' is disposed inboard of or at or against the inner perimeter edge region of the seal, while remaining within the spirit and scope of the present invention.

Figure 13:
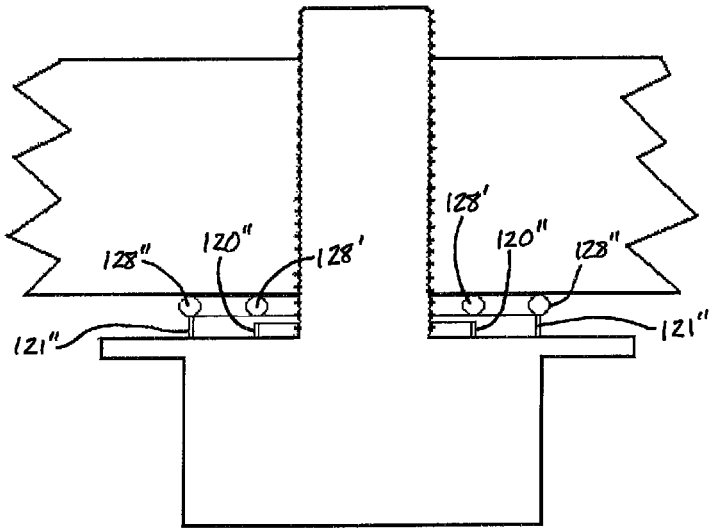
FIG. 13 is a side sectional view of another ribbed drain plug having two spaced annular ribs for engaging respective annular seals, shown with the drain plug partially threaded into the drain hole of an oil pan.

Although shown as having multiple ribs of substantially identical height, it will be appreciated that a drain plug may have ribs that may be different in height without departing from the spirit and scope of the present invention. For example, the outboard rib 121" may be taller or project further from the planar surface of the head portion than the inboard rib 120" (such as shown in FIG. 13), or vice versa, so that a different pressure may be applied to the resilient seals 128', 128" corresponding to the respective ribs 120", 121". It is further envisioned that a drain plug may have multiple concentric ribs or projections that are progressively longer or taller as their diameters increase so that the outer rib or ribs are longer or taller than the inner rib or ribs. Optionally, the resilient seal may be shaped or configured to accommodate or adapt to the different length ribs to further enhance the seal between the drain plug and the container or oil pan. For example, the resilient seal may have a generally conical profile or cross sectional shape (such as a hollow frusto-conical shape or profile) so that ribs of different heights contact and impinge on the seal to a similar degree.

Therefore, the present invention provides an enhanced sealing system including a drain plug having one or more annular ribs or ridges surrounding a shaft (such as a threaded shaft) and arranged so as to impinge or bite into an annular deformable seal positioned around a drain hole into which the drain plug is threaded. At least one annular rib of the drain plug compresses and bites into at least one corresponding deformable seal to enhance the sealing properties of the drain plug in the drain hole. Additional annular ribs and/or annular deformable seals may be provided to support and maintain alignment of the deformable seals with the ribs, and/or to provide additional sealing surfaces or interfaces.

Changes and modifications to the specifically-described embodiments may be carried out without departing from the principles of the present invention, which is intended to be limited only by the scope of the appended claims, as interpreted according to the principles of patent law, including the doctrine of equivalents.

The embodiments of the invention in which an exclusive property is claimed are defined as follows:

1. A drain plug for sealingly engaging a fluid drain hole in a fluid container, said drain plug comprising:

a shaft, said shaft configured to be received in a passageway of the fluid container;

a head portion at one end of said shaft, said head portion comprising a tool-engaging portion for receiving a tool for rotating said drain plug, and said head portion comprising a generally planar surface facing forwardly in the direction of said shaft and generally orthogonal to said shaft, said head portion having a perimeter edge portion spaced radially outwardly from said shaft;

at least one annular rib disposed at said generally planar surface of said head portion, said at least one annular rib projecting forwardly from said generally planar surface in the direction of said shaft and disposed substantially concentrically with said shaft so that said at least one annular rib is spaced radially outwardly from said shaft to define a gap between said at least one annular rib and said shaft, and is spaced radially inwardly from said perimeter edge portion of said head portion to define a gap between said at least one annular rib and said perimeter edge portion, wherein a distal end of said at least one annular rib comprises the forwardmost portion of said head portion; and wherein said distal end of said at least one annular rib axially and compressively engages a deformable seal that is disposed substantially concentrically around the passageway of the fluid container when said shaft is driven into the passageway to secure said drain plug at the passageway of the container.

2. The drain plug of claim 1, wherein said head portion, said at least one annular rib, and said shaft are unitarily formed.

3. The drain plug of claim 1, wherein said at least one annular rib comprises first and second annular ribs disposed at said generally planar surface of said head portion, said first and second annular ribs projecting from said generally planar surface in the direction of said shaft and disposed substantially concentrically with said shaft and said second annular rib spaced radially outwardly from said first annular rib.

4. The drain plug of claim 3, wherein said second annular rib is configured to axially and compressively engage a second deformable seal that is disposed substantially concentrically around the passageway of the fluid container when said shaft is driven into the passageway.

5. The drain plug of claim 3, wherein one of said first and second annular ribs projects further from said generally planar surface than the other of said first and second annular ribs.

6. The drain plug of claim 1, wherein said at least one annular rib has a radial thickness that is less than the radial thickness of the deformable seal.

7. The drain plug of claim 1, wherein said head portion comprises a flange adjacent said shaft, said flange defining said generally planar surface and extending radially outwardly beyond said tool-engaging portion of said head portion.

8. The drain plug of claim 1, wherein said shaft comprises a threaded shaft and the passageway comprises a correspondingly threaded passageway, and wherein said threaded shaft is rotatable within the threaded passageway to drive and tighten said threaded shaft into the threaded passageway.

9. The drain plug of claim 1, wherein said at least one annular rib comprises one chosen from a rectangular cross-section, a rounded cross-section, a triangular cross-section, and a curved cross-section.

10. A drain hole sealing system comprising:

a fluid container having a wall and defining a fluid drain hole in said wall;

a drain plug configured to be partially received in said drain hole to seal said drain hole, wherein said drain plug comprises a shaft, a head portion and at least one annular rib;

a deformable seal disposed substantially concentrically around said drain hole of said fluid container;

wherein said shaft of said drain plug is configured to be received in said drain hole in said wall of said fluid container;

wherein said head portion of said drain plug is disposed at one end of said shaft, said head portion configured to be engaged by a tool for rotating said drain plug, said head portion comprising a generally planar surface facing forwardly in the direction of said shaft, said head portion having a perimeter edge portion spaced radially outwardly from said shaft;

wherein said at least one annular rib of said drain plug is disposed along said generally planar surface of said head portion, said at least one annular rib projecting forwardly from said generally planar surface in the direction of said shaft and disposed substantially concentrically with said shaft so that said at least one annular rib is spaced radially outwardly from said shaft to define a gap between said at least one annular rib and said shaft, and is spaced radially inwardly from said perimeter edge portion of said head portion to define a gap between said at least one annular rib and said perimeter edge portion, wherein a distal end of said at least one annular rib comprises the forwardmost portion of said head portion; and wherein said distal end of said at least one annular rib axially and compressively engages said deformable seal when said shaft is received in and driven into said drain hole to secure said drain plug at said drain hole of said container.

11. The drain hole sealing system of claim 10, wherein said head portion, said at least one annular rib and said shaft of said drain plug are unitarily formed.

12. The drain hole sealing system of claim 10, wherein said at least one annular rib comprises first and second annular ribs at said generally planar surface, said first and second annular ribs projecting from said generally planar surface in the direction of said shaft and disposed substantially concentrically with said shaft and said second annular rib spaced radially outwardly from said first annular rib.

13. The drain hole sealing system of claim 12, wherein said second annular rib is adapted to axially and compressively engage a second deformable seal that is disposed substantially concentrically around said drain hole of said fluid container when said shaft is driven into said drain hole.

14. The drain hole sealing system of claim 12, wherein one of said first and second annular ribs projects further from said generally planar surface than the other of said first and second annular ribs.

15. The drain hole sealing system of claim 10, wherein said at least one annular rib has a radial thickness that is less than the radial thickness of said deformable seal.

16. The drain hole sealing system of claim 10, wherein said head portion comprises a flange adjacent said shaft, said flange defining said generally planar surface and extending radially outwardly beyond said tool-engaging region of said head portion.

17. The drain hole sealing system of claim 10, wherein said shaft comprises a threaded shaft and said drain hole comprises a correspondingly threaded drain hole, and wherein said threaded shaft is rotatable within said threaded drain hole to drive and tighten said threaded shaft into said threaded drain hole.

18. The drain hole sealing system of claim 10, wherein said at least one annular rib comprises one chosen from a rectangular cross-section, a rounded cross-section, a triangular cross-section, and a curved cross-section.

19. The drain hole sealing system of claim 10, wherein said deformable seal comprises one chosen from an O-ring and a flat annular seal.

20. The drain hole sealing system of claim 10, wherein said wall of said fluid container comprises an annular groove substantially concentric with said drain hole, and wherein said deformable seal is at least partially received within said groove.

21. The drain hole sealing system of claim 10, wherein the inner diameter of said deformable seal is substantially equal to the outer diameter of said shaft.

22. The drain hole sealing system of claim 10, wherein said container comprises an oil pan of a vehicle.

* * * * *